US009409048B1

(12) United States Patent
Hopperstad et al.

(10) Patent No.: US 9,409,048 B1
(45) **Date of Patent: *Aug. 9, 2016**

(54) RETRACTABLE WALL MOUNTED EXERCISE RACK SYSTEM

(71) Applicant: PRX Performance, Inc., Fargo, ND (US)

(72) Inventors: Erik S. Hopperstad, Moorhead, MN (US); Brian B. Brasch, West Fargo, ND (US)

(73) Assignee: PRX Performance, LLC, Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/149,775

(22) Filed: May 9, 2016

Related U.S. Application Data

(63) Continuation of application No. 14/682,431, filed on Apr. 9, 2015, now Pat. No. 9,333,387.

(60) Provisional application No. 61/977,435, filed on Apr. 9, 2014.

(51) Int. Cl.

| | |
|---|---|
| ***A63B 1/00*** | (2006.01) |
| ***A63B 21/06*** | (2006.01) |
| ***A63B 21/078*** | (2006.01) |
| ***A63B 21/068*** | (2006.01) |

(Continued)

(52) U.S. Cl.

CPC ..... *A63B 21/068* (2013.01); *A63B 21/00047* (2013.01); *A63B 21/078* (2013.01); *A63B 21/169* (2015.10); *A63B 21/4029* (2015.10); *A63B 21/4035* (2015.10); *A63B 23/1218* (2013.01); *A63B 2023/0411* (2013.01); *A63B 2208/029* (2013.01); *A63B 2210/00* (2013.01); *A63B 2225/093* (2013.01)

(58) Field of Classification Search

CPC ..... A63B 21/00047; A63B 21/068; A63B 21/169; A63B 21/16; A63B 21/1618; A63B 21/1627; A63B 21/1636; A63B 21/1645; A63B 21/1654; A63B 21/1663; A63B 21/1681; A63B 21/072; A63B 21/0724; A63B 21/078; A63B 21/0783; A63B 21/4035; A63B 21/4029; A63B 7/00; A63B 23/1218; A63B 2023/0411; A63B 2208/029; A63B 2210/00; A63B 2210/10; A63B 2210/50; A63B 2210/56; A63B 2210/58; Y10S 248/917; B60R 3/02; A47B 46/00; A47B 46/005; A61G 7/1019; F16M 11/046; F16M 11/10; F16M 2200/063

USPC ..... 482/38

See application file for complete search history.

(56) References Cited

U.S. PATENT DOCUMENTS

| | | | |
|---|---|---|---|
| 1,104,505 | A | 7/1914 | Holworthy |
| 2,855,200 | A | 10/1958 | Blickman |

(Continued)

*Primary Examiner* — Oren Ginsberg
*Assistant Examiner* — Joshua Lee
(74) *Attorney, Agent, or Firm* — Neustel Law Offices; Michael S. Neustel

(57) ABSTRACT

A retractable wall mounted exercise rack system for providing an exercise rack that may be easily and compactly stored when not in use. The retractable wall mounted exercise rack system generally includes one or more brackets attached to a wall, a pair of support members, and a plurality of arms pivotally extending from the brackets and pivotally connecting to the support members. One or more actuators are connected between the brackets and the arms to assist in lifting the structure into a compact retracted position for storage.

20 Claims, 14 Drawing Sheets

(51) Int. Cl.

| | |
|---|---|
| ***A63B 23/12*** | (2006.01) |
| ***A63B 21/00*** | (2006.01) |
| *A63B 23/04* | (2006.01) |

(56) References Cited

U.S. PATENT DOCUMENTS

| | | | |
|---|---|---|---|
| 3,614,097 | A | 10/1971 | Blickman |
| 3,874,657 | A | 4/1975 | Niebojewski |
| 4,844,448 | A | 7/1989 | Niznik |
| 4,927,135 | A | 5/1990 | Nieppola |
| 5,046,722 | A | 9/1991 | Antoon |
| 5,249,858 | A | 10/1993 | Nusser |
| 6,073,624 | A | 6/2000 | Laurent |
| 6,328,679 | B1 | 12/2001 | Croft |
| 8,047,972 | B1 | 11/2011 | Dean |
| 2008/0276551 | A1 | 11/2008 | Thomas |
| 2009/0289535 | A1 | 11/2009 | Weber |
| 2013/0257242 | A1 | 10/2013 | Bunch |
| 2015/0148197 | A1 | 5/2015 | Lentz |
| 2016/0016033 | A1 | 1/2016 | Schrag |

RETRACTABLE WALL MOUNTED EXERCISE RACK SYSTEM

CROSS REFERENCE TO RELATED APPLICATIONS

The present application is a continuation of U.S. application Ser. No. 14/682,431 filed on Apr. 9, 2015, which claims priority to U.S. Provisional Application No. 61/977,435 filed Apr. 9, 2014. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

1. Field of the Invention

Example embodiments in general relate to exercise equipment and more specifically it relates to a retractable wall mounted exercise rack system for providing an exercise rack that may be easily and compactly stored when not in use.

2. Description of the Related Art

Any discussion of the related art throughout the specification should in no way be considered as an admission that such related art is widely known or forms part of common general knowledge in the field.

Conventional exercise racks for use in working out with a weighted barbell have been in use for years. Examples of convention exercise racks include squat stands, squat racks, squat cages, power racks and rigs. Conventional exercise racks are used for various types of exercises such as, but not limited to, squatting, bench presses, pull-ups and the like. A conventional exercise rack is comprised of a base, four vertical supports extending upwardly from the base and an upper connecting structure attached to the upper portions of the vertical supports. The vertical supports include spaced apart openings for receiving various types of support brackets (e.g. J-cups) to receive a barbell at various heights. One or more pull-up bars may also be attached to upper portions of the exercise rack allowing the user to perform pull-up exercises on the exercise rack.

One problem with conventional exercise racks is they require a significant amount of space to utilize. Another problem with conventional exercise racks is they are not capable of being compactly stored without disassembling them.

Because of the inherent problems with the related art, there is a need for a new and improved retractable wall mounted exercise rack system for providing an exercise rack that may be easily and compactly stored when not in use.

BRIEF SUMMARY OF THE INVENTION

An example embodiment of the retractable wall mounted exercise rack is directed to an exercise device which includes an upper bracket and a lower bracket attachable to a wall, a pair of support members, and a plurality of arms pivotally extending from the brackets and pivotally connecting to the support members. One or more actuators are connected between the brackets and the arms to assist in lifting the structure into a compact retracted position for storage.

There has thus been outlined, rather broadly, some of the features of the exercise device in order that the detailed description thereof may be better understood, and in order that the present contribution to the art may be better appreciated. There are additional features of the exercise device that will be described hereinafter and that will form the subject matter of the claims appended hereto. In this respect, before explaining at least one embodiment of the invention in detail, it is to be understood that the exercise device is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the exercise device will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
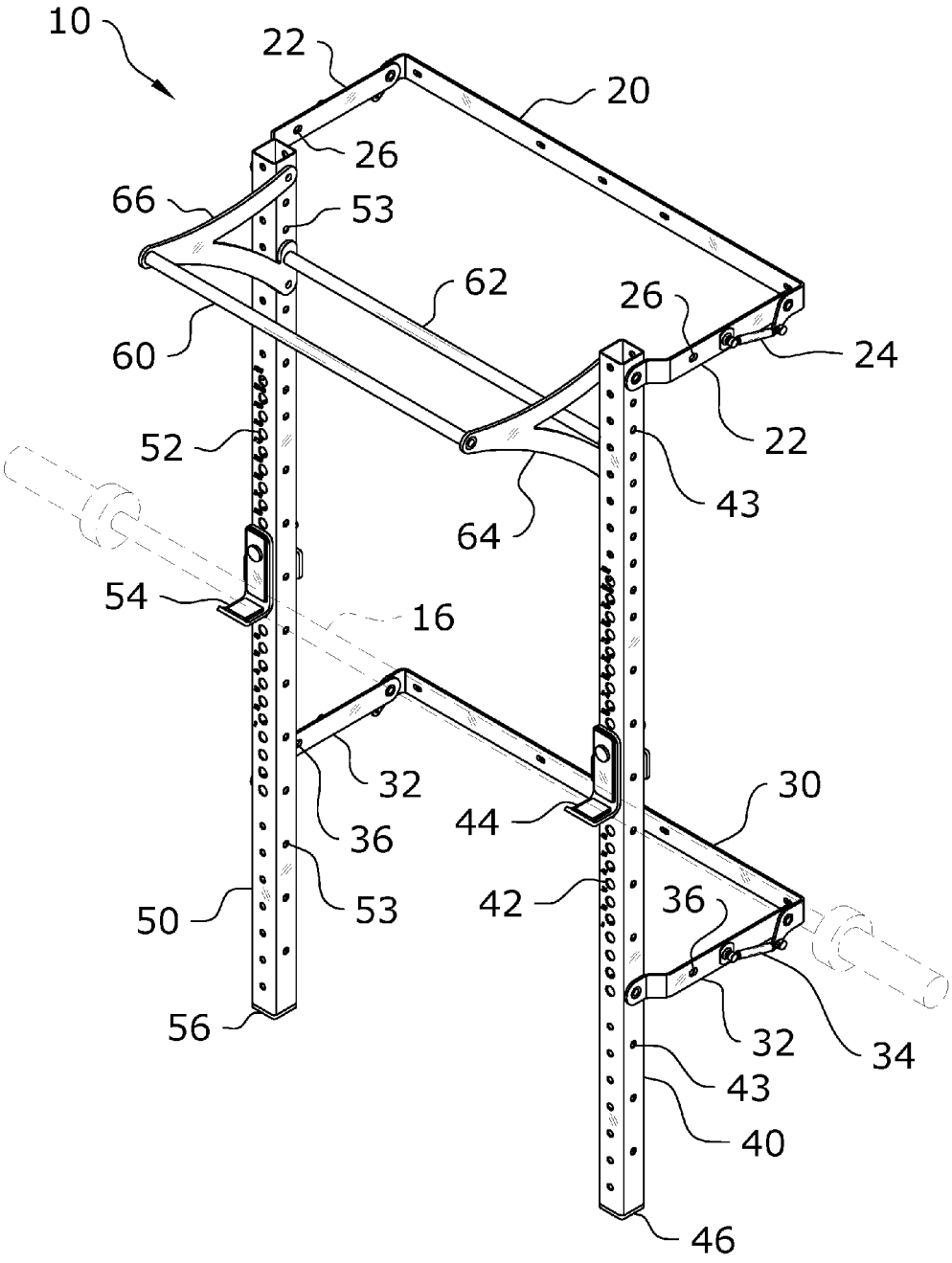
FIG. 1 is a first front perspective view of the retractable wall mounted exercise rack in the extended position for usage.

Turning now descriptively to the drawings, in which similar reference characters denote similar elements throughout the several views, FIGS. 1 through 11 illustrate a retractable wall mounted exercise rack system 10, which comprises an upper bracket 20 and a lower bracket 30 attachable to a wall 14, a pair of support members 40, 50, and a plurality of arms 22, 32 pivotally extending from the brackets 20, 30 and pivotally connecting to the support members 40, 50. One or more actuators 24, 34 are connected between the brackets 20, 30 and the arms 22, 32 to assist in lifting the structure into a compact retracted position for storage. The retractable wall mounted exercise rack may be attached to various building structures such as, but not limited to, the interior or exterior of a building structure, a garage, a gym, a bedroom and the like. It can be appreciated that the retractable wall mounted exercise rack may be utilized with a single rack system with only two support members 40, 50 or a multiple rack system with more than two support members 40, 50.

The retractable wall mounted exercise rack preferably pivots upwardly and downwardly with respect to the wall 14 for compact storage of the invention. However, the retractable wall mounted exercise rack may also pivot from side-to-side with respect to the wall 14 without being elevated with the pivot axis rotated 90 degrees with respect to the pivot axis illustrated in FIGS. 1 through 11 of the drawings. The retractable wall mounted exercise rack may also be pivoted diagonally at various angles with respect to the wall 14. As can be appreciated, the retractable wall mounted exercise rack may pivot with respect to the wall 14 along a horizontal axis (FIGS. 1 through 11), a vertical axis or a diagonal axis. One important feature and function of the retractable wall mounted exercise rack is the ability to move the support members 40, 50 from an extended position where the support members 40, 50 are distally spaced away from the wall 14 (FIG. 8*a*) to a retracted position that is compact and substantially flush with the wall 14 (FIG. 8*c*). When in the extended position, the support members 40, 50 are preferably at least 20 inches away from the wall 14 measured from the outside surface of the front of the support members 40, 50 to the surface of the wall 14 to provide sufficient space for a user to perform various types of exercises (e.g. kipping pull-ups, butterfly pull-ups, weighted pull-ups, toes to bar, etc.). When in the retracted position, the support members 40, 50 are preferably less than 4 inches away from the wall 14 measured from the outside surface of the front of the support members 40, 50 to the surface of the wall 14 to provide a compact storage structure that does not interfere with the usage of the surrounding space.

B. Brackets

The arms 22, 32 are pivotally attached to the wall 14 with one or more brackets 20, 30. Each arm 22, 32 may have its own individual bracket 20, 30 for pivotally attaching to the wall 14. Each of the brackets 20, 30 includes one or more apertures or extended structures that receive a fastener (e.g. a threaded fasteners, lag bolts, lag screws, etc.) that extends into the wall 14 and preferably into a stud within the wall 14 to securely retain the bracket 20, 30.

The apertures extending through the brackets 20, 30 may have various shapes such as circular, oval, slotted and the like. The apertures extending through the brackets 20, 30 are preferably aligned with the distance of conventional frame studs in a wall 14 such as, but not limited to, 16 inch intervals and/or 24 inch intervals. FIG. 8*c* illustrates the usage of threaded fasteners to secure the brackets 20, 30 to the wall 14.

When attached to the wall 14, the brackets 20, 30 are preferably positioned above the floor 12 a distance at least equal to the vertical distance the support members 40, 50 travel when going from the extended position (FIG. 8*a*) to the retracted position (FIG. 8*c*). The brackets 20, 30 may be permanently or removably attached in a pivotal manner to the arms 22, 32.

Alternatively, each bracket 20, 30 may be used to pivotally support two or more of the arms 22, 32. For example, FIGS. 1 through 9 illustrate the usage of an upper bracket 20 adapted to be attached to the wall 14 and a lower bracket 30 adapted to be attached to the wall 14 below the upper bracket 20. As another alternative, each bracket 20, 30 may be rotated 90 degrees wherein each bracket 20, 30 supports at least one of the upper arms 22 and at least one of the lower arms 32. The upper bracket 20 is preferably attached to the wall 14 in a manner that is parallel with respect to the lower bracket 30 as illustrated in FIG. 9 of the drawings.

As further shown in FIGS. 1 through 9, the upper bracket 20 and the lower bracket 30 each have a U-shaped structure with an elongated flat brace adjacent to and attached to the wall 14 with end portions that extend outwardly away from the wall 14 to pivotally connect to the arms 22, 32. The end portions of the brackets 20, 30 preferably extend outwardly from the elongated flat brace at 90 degrees. The length of the flat brace portion of the upper bracket 20 and the lower bracket 30 is preferably approximately 48 inches or greater to provide sufficient spacing between the support members 40, 50 while providing for secure attachment to studs in the wall 14 which are typically spaced apart at 16 inches. Various other shapes and structures may be utilized for the brackets 20, 30 that are capable of pivotally supporting the arms 22, 32. The flat brace portion is preferably constructed of a flat metal bar (e.g. a ⅜ inch thick steel flat bar) to allow the support members 40, 50 to get near or adjacent to the surface of the wall 14 when in the retracted position.

Figure 8A:
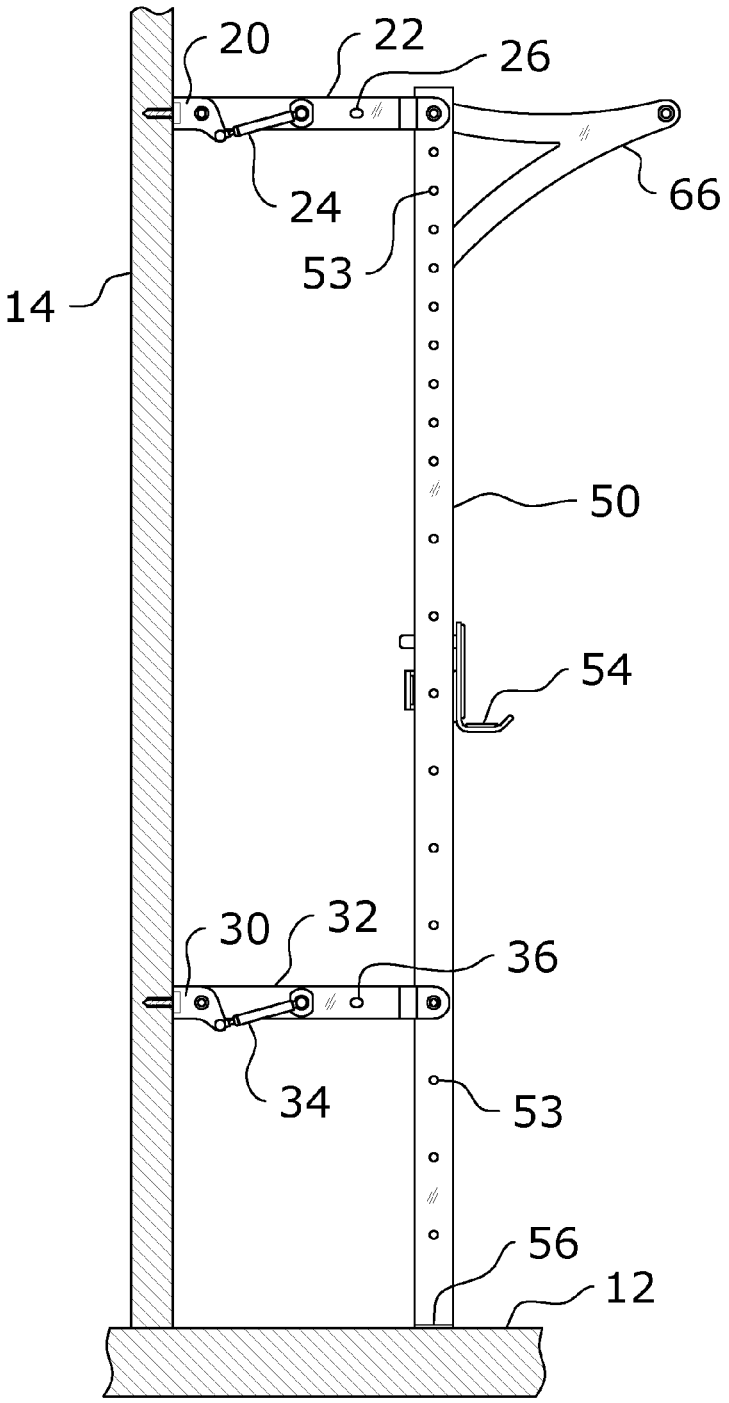
FIG. 8*a* is a left side view of the retractable wall mounted exercise rack attached to a wall in the extended position for usage with the arms horizontally aligned.
Figure 8B:
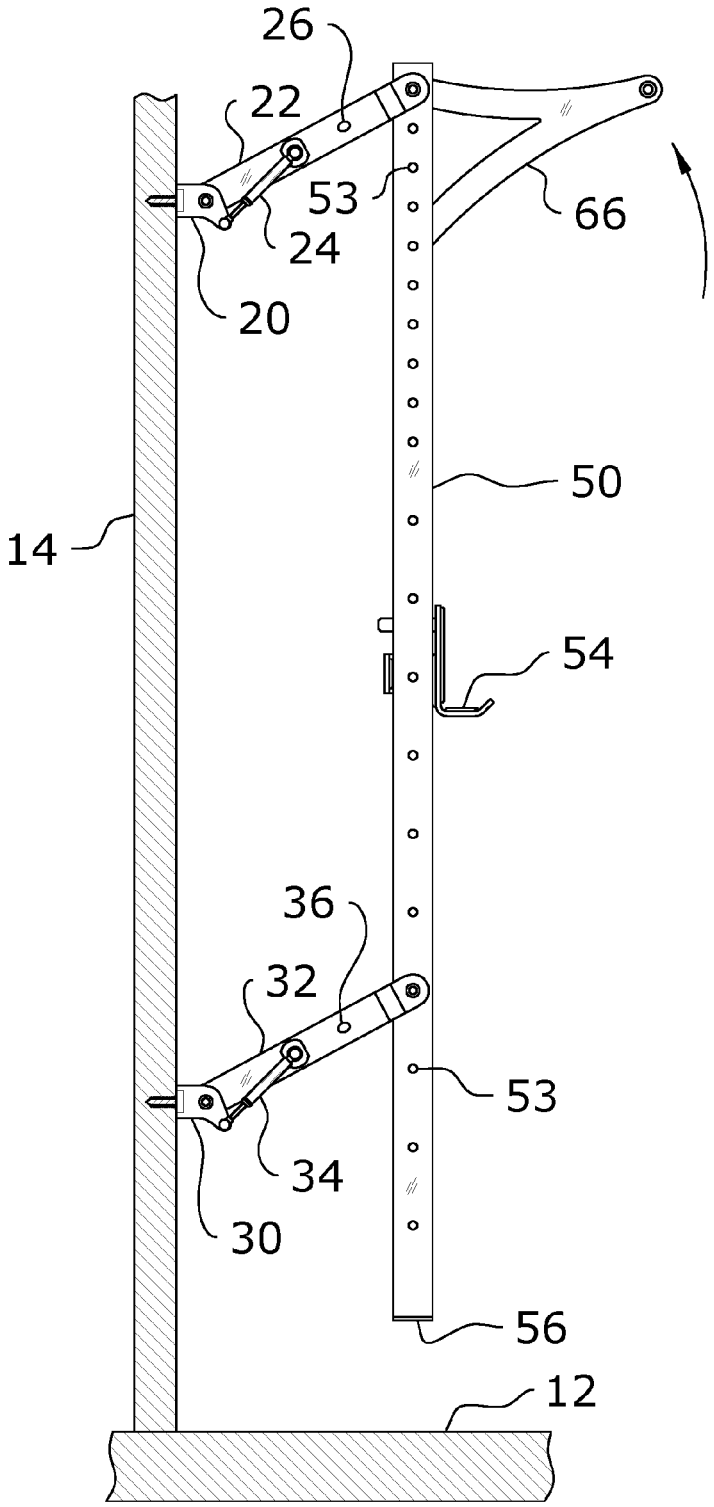
FIG. 8*b* is a left side view of the retractable wall mounted exercise rack being moved into the retracted position.
Figure 8C:
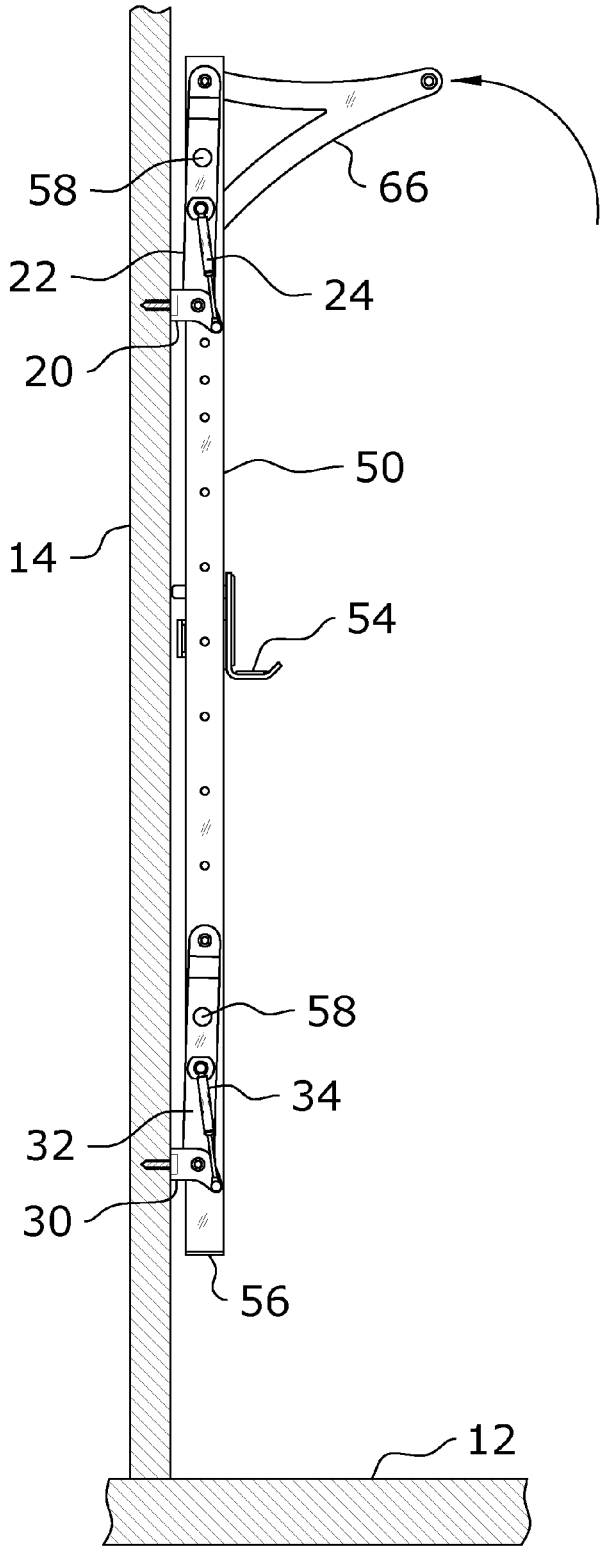
FIG. 8*c* is a left side view of the retractable wall mounted exercise rack in the retracted position for compact storage.
Figure 8D:
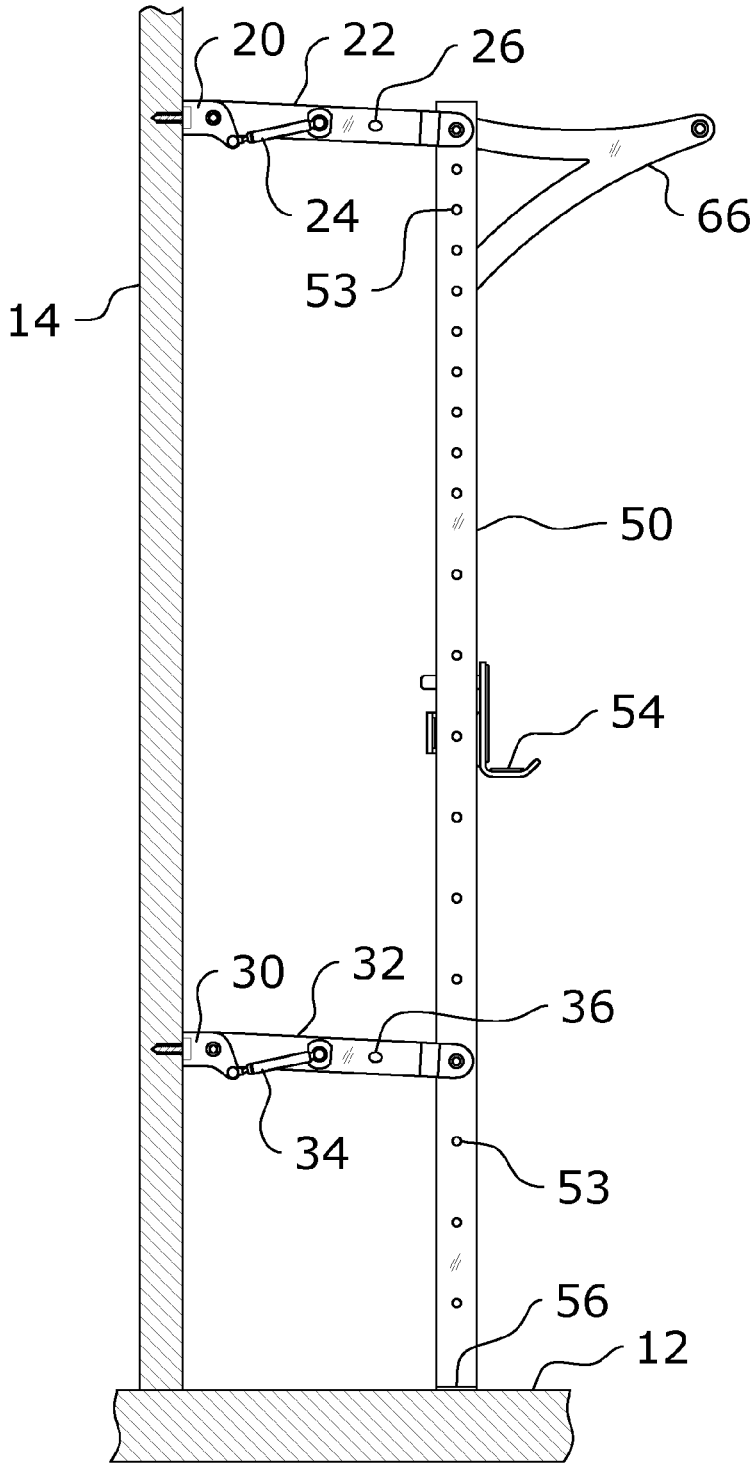
FIG. 8*d* is a left side view of the retractable wall mounted exercise rack attached to a wall in the extended position for usage with the arms angled downwardly from the wall.
Figure 9:
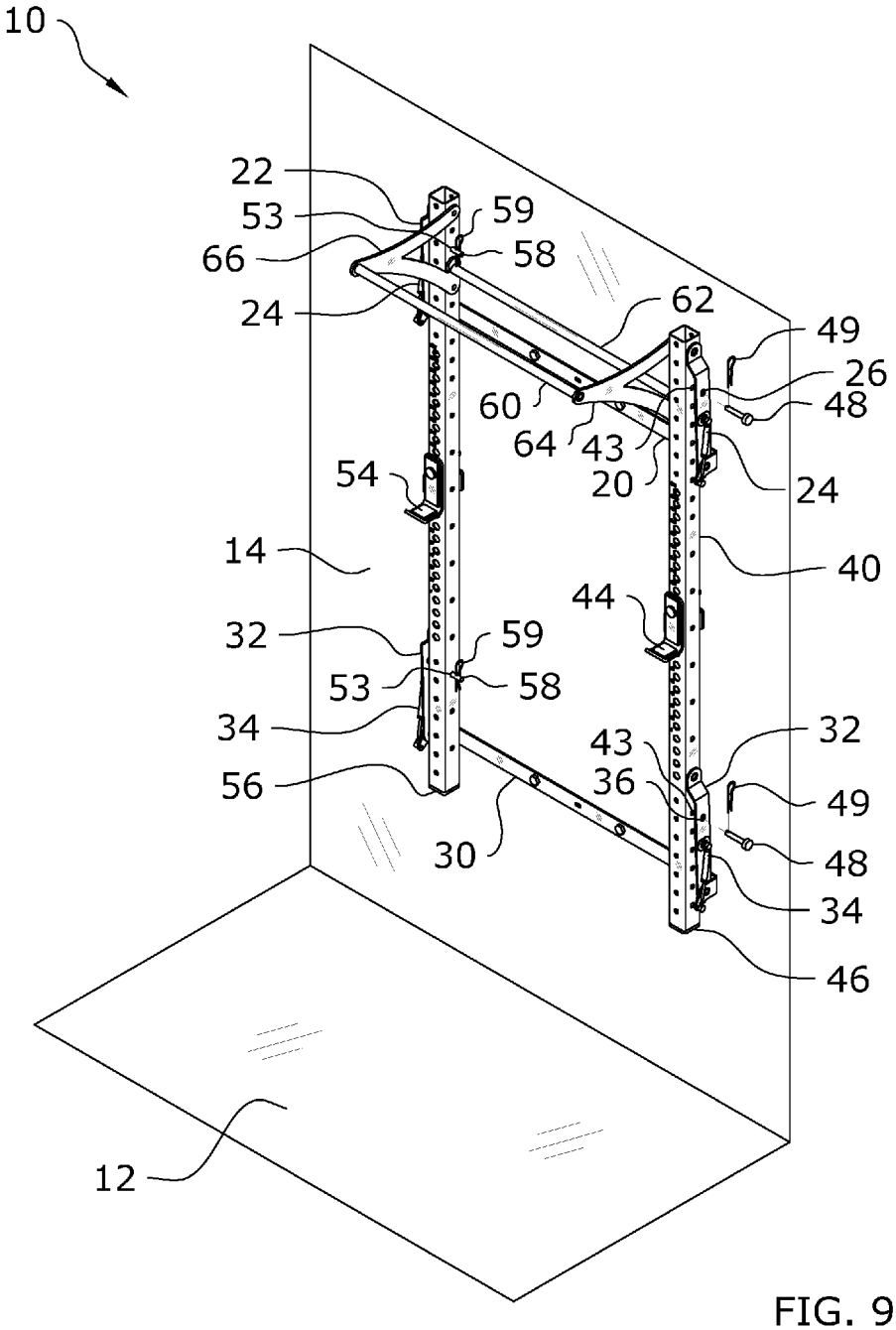
FIG. 9 is a first front perspective view of the retractable wall mounted exercise rack attached to a wall and in the compact retracted position.

The end portions of the brackets 20, 30 preferably include an extended portion that extends downwardly and forwardly for pivotally connecting to an end of the corresponding actuator 24, 34 to be offset from the corresponding arms 22, 32 thereby allowing the actuators 24, 34 to provide an offsetting force to the arms 22, 32 during the entire range of movement of the arms 22, 32 from the extended position to the retracted position as best illustrated in FIGS. 8*a* through 8*c* of the drawings.

Figure 2:
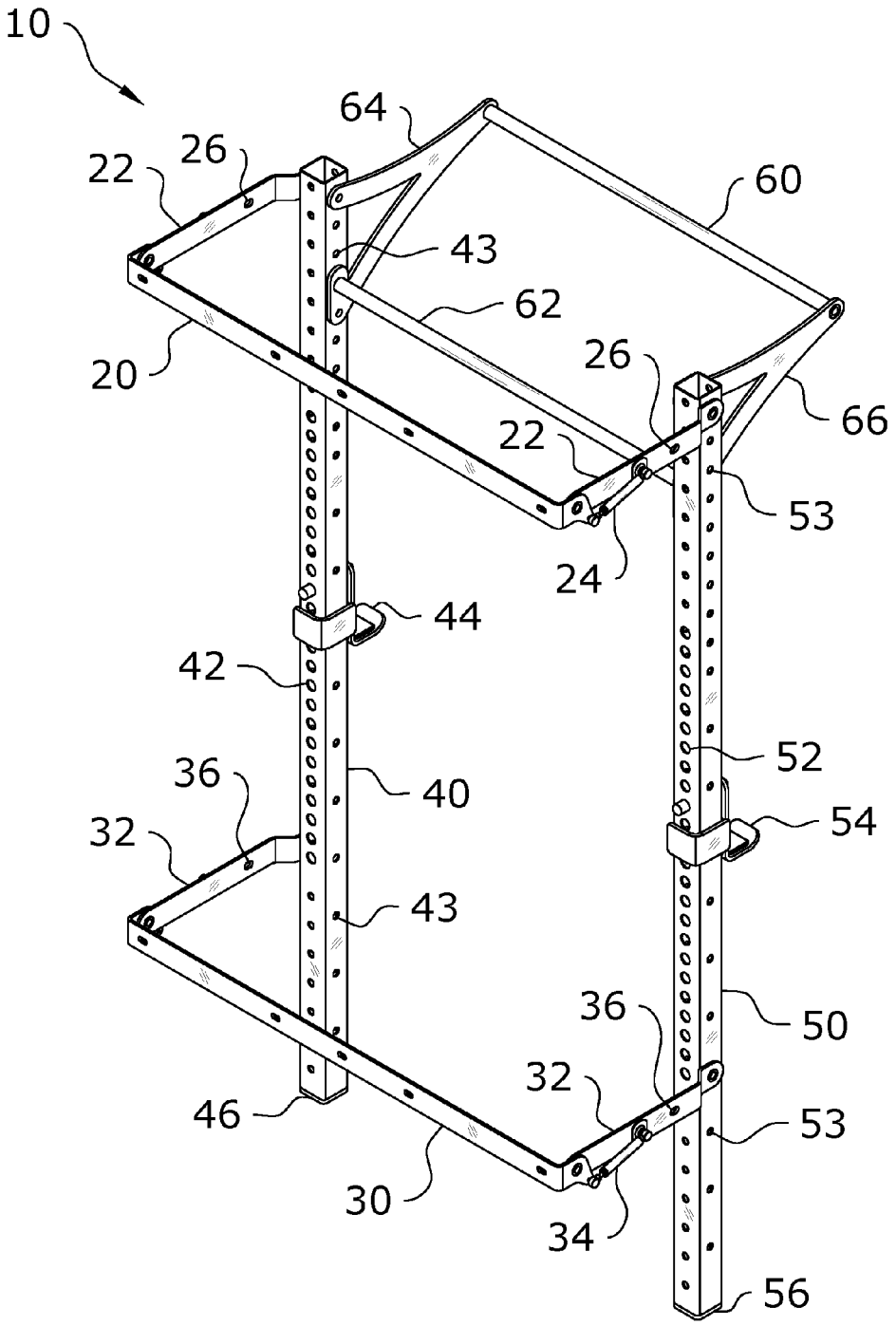
FIG. 2 is a first rear perspective view of the retractable wall mounted exercise rack in the extended position.

The upper bracket 20 pivotally supports a pair of upper arms 22 and the lower bracket 30 pivotally supports a pair of lower arms 32 as shown in FIGS. 1 and 2 of the drawings. The upper arms 22 preferably have a concentric pivot point on the upper bracket 20 and on the support members 40, 50. The lower arms 32 also preferably have a concentric pivot point on the lower bracket 30 and on the support members 40, 50 which is positioned below the pivot point of the upper arms 22.

It is preferable that the upper arms 22 are pivotally attached to an upper end portion of the support members 40, 50 to provide increased stability to the support members 40, 50 during use. The lower arms 32 are pivotally attached to the lower portion of the support members 40, 50 at a height approximately equal to the height the lower arms 32 are pivotally attached to the wall 14 so that the lower arms 32 extend substantially horizontal when the invention is in the extended position as best illustrated in FIG. 8*a* of the drawings. The upper arms 22 are pivotally attached to the wall 14 and to the upper end portion of the support members 40, 50 such that the upper arms 22 are substantially horizontal or angled slightly downwardly from the wall 14 (e.g. 5 degrees or less) when the invention is in the extended position as further illustrated in FIG. 8*a* of the drawings.

It is preferable that the upper arms 22 are parallel to the lower arms 32 when the invention is in the extended position as illustrated in FIG. 8*a* of the drawings. It is further preferable that the upper arms 22 are parallel to the lower arms 32 when in the retracted position as illustrated in FIG. 8*c* of the drawings. It is also further preferable that the upper arms 22 are parallel to the lower arms 32 at all locations from the extended position to the retracted position and between the respective positions as illustrated in FIGS. 8*a* through 8*c* of the drawings. The arms 22, 32 are preferably parallel with one another at all times in all positions of the supports members 40, 50.

C. Support Members

The retractable wall mounted exercise rack includes a first support member 40 and a second support member 50. The support members 40, 50 further provide an adjustable support for a barbell 16. The support members 40, 50 also provide support for one or more pull-up bars. The support members 40, 50 are each comprised of an elongated and preferably straight structure having a lower end and an upper end.

Figure 10:
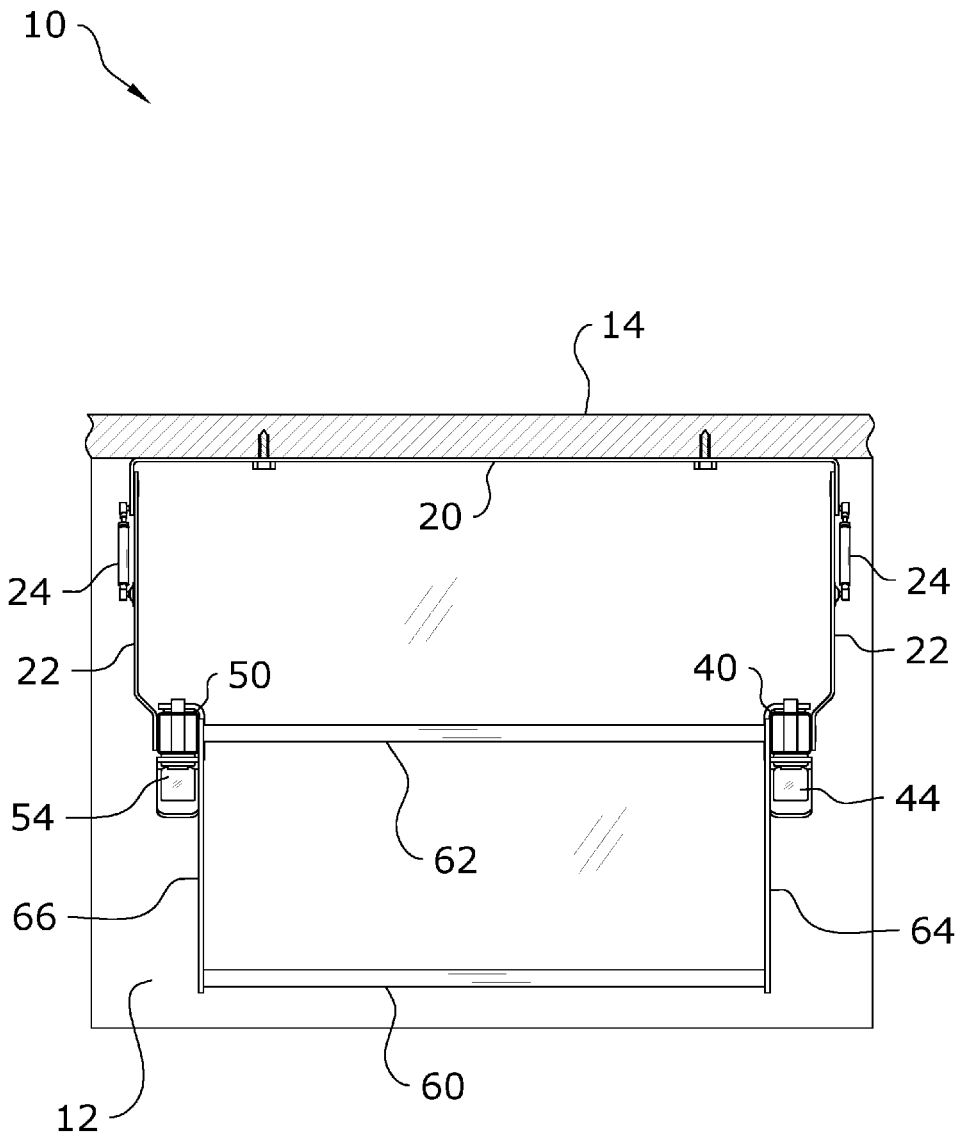
FIG. 10 is a top view of the retractable wall mounted exercise rack attached to a wall and in the extended position.

The second support member 50 is distally spaced apart from the first support member 40 to provide a space for the user exercising to position their body. The support members 40, 50 are preferably distally spaced apart approximately 48 inches or less. The spacing between the support members 40, 50 is preferably less than the length of the brackets 20, 30 as illustrated in FIG. 10 of the drawings, however, the spacing may be equal to or greater than the length of the brackets 20, 30.

Figure 11:
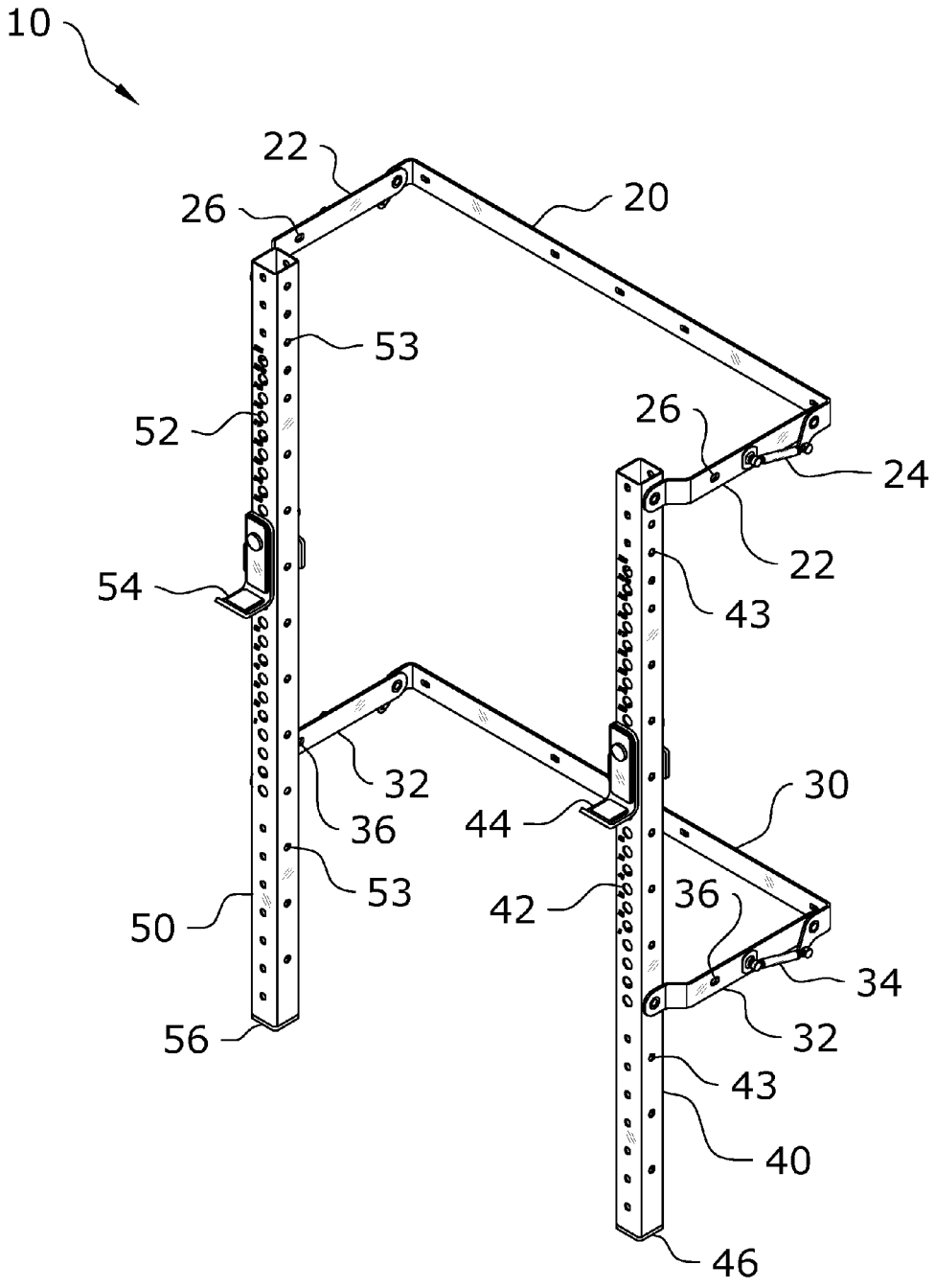
FIG. 11 is a first front perspective view of an alternative embodiment for a retractable squat rack without a pull-up bar.

The support members 40, 50 preferably have the same length but may differ in length from one another. The length of the support members 40, 50 is preferably 7.5 feet or 8 feet when utilized as a combination pull-up rack and squat rack. The length of the support members 40, 50 may be shorter for the alternative embodiment comprised of just a squat rack such as 6 feet as illustrated in FIG. 11 of the drawings.

The support members 40, 50 are preferably constructed of square tubing (e.g. 2"×2", 3"×3", 4"×4") but may also be constructed of rectangular tubing (e.g. 2"×3", 3"×4"). The support members 40, 50 are preferably tubular, but may be constructed of a solid material (e.g. a metal rod) or a shaped material (e.g. U-shaped cross section). The support members 40, 50 are preferably constructed of a metal material sufficient in strength to provide support for a weighted barbell 16 having a weight of 600 pounds or more. It is also important that the support members 40, 50 are tubular to provide the strength needed to support a weighted barbell 16 while providing a relatively lightweight structure that may be lifted upwardly into the retracted position by the user without significant physical effort.

The first support member 40 is parallel with respect to the second support member 50 as illustrated in FIGS. 1 through 11 of the drawings. The support members 40, 50 are further substantially parallel with respect to the wall 14 in both the extended position and the retracted position (and the positions between thereof) as illustrated in FIGS. 8*a* through 8*c* of the drawings. The first support member 40 and the second support member 50 are vertically orientated when in the extended position, the retracted position and in all positions between the extended position and the retracted position as shown in FIGS. 8*a* through 8*d* of the drawings.

The lower ends of the support members 40, 50 engage a floor 12 when in the extended position and are distally spaced above the floor 12 when in the retracted position as illustrated in FIGS. 8*a* through 8*d* of the drawings. The lower ends of the support members 40, 50 preferably include a first end cap 46 and a second end cap 56 respectively. The end caps 46, 56 are comprised of a material softer than the support members 40, 50 to prevent damage to the floor 12 and reduce movement during use such as, but not limited to, plastic or rubber. The end caps 46, 56 are preferably inserted into the lower opening within the lower end of the support members 40, 50 and overlap the lower edges of the support members 40, 50. It is preferable that the lower ends of the support members 40, 50 are not attached to the floor 12 to allow for free upward movement by the user when desired.

The first support member 40 and the second support member 50 each include a plurality of first apertures 42 and a plurality of second apertures 52 respectively adapted to removably receive a first support bracket 44 and a second support bracket 54. The support brackets 44, 54 may be comprised of various types of bar catchers such as, but not limited to, a J-cup (a.k.a. a J-hook) commonly utilized with conventional squat racks to removably receive and support a barbell 16 as illustrated in FIGS. 1 through 11 of the drawings. The support brackets 44, 54 have a pin that removably inserts into a selected aperture 42, 52 at a selected height along the support members 40, 50 based on the height of the user and/or the type of exercise being performed. The front portion of the support brackets 44, 54 includes a hook structure that supports the barbell 16 in a stationary position with respect to the support members 40, 50. The support brackets 44, 54 further include an L-shaped structure that extends around and behind the support members 40, 50 to prevent accidental removal of the support brackets 44, 54 during an exercise.

As discussed previously, the support members 40, 50 have an extended position (e.g. see FIG. 8*a*) and a retracted position (e.g. see FIG. 8*c*). The support members 40, 50 are positioned near or adjacent to the wall 14 when in the retracted position and the support members 40, 50 are distally positioned away from the wall 14 when in the extended position as shown in FIGS. 8*a* and 8*c* of the drawings. The support members 40, 50 are preferably positioned higher when in the retracted position than when in the extended position as further shown in FIGS. 8*a* through 8*c* of the drawings. The distance from the wall 14 to an outer surface of the support members 40, 50 is significantly less when the support members 40, 50 are in the retracted position than when the support members 40, 50 are in the extended position. The distance from the wall 14 to an outer surface of the support members 40, 50 is preferably less than four inches when the support members 40, 50 are in the retracted position to reduce interference with the usage of the surrounding area (e.g. parking a vehicle within a garage).

The first support member 40 may be directly connected to the second support member 50 by a cross member and/or a pull-up bar. The support members 40, 50 may be connected together at the upper portion and/or the lower portion thereof. It is preferable not to have any direct connection between the support members 40, 50 from the lower end to near the upper portion to prevent interference with an individual working out between the support members 40, 50. However, the first support member 40 may not be directly connected to the second support member 50 as illustrated in FIG. 11 of the drawings.

FIGS. 1 through 10 illustrate a first pull-up bar 60 connected between upper portions of the first support member 40 and the second support member 50 by a first side support 64 and a second side support 66. The height of the first pull-up bar 60 may be adjusted by securing the side supports 64, 66 to various heights along the support members 40, 50. In addition, a second pull-up bar 62 may be connected between the support members 40, 50 at a level below or above the first pull-up bar 60. The second pull-up bar 62 is connected directly between the support members 40, 50 as illustrated in FIGS. 1 through 6 of the drawings. It can be appreciated that only a single pull-up bar may be connected between the support members 40, 50 either directly such as the second pull-up bar 62 or indirectly with the side supports 64, 66 such as the first pull-up bar 60. The pull-up bars 60, 62 may have various widths such as, but not limited to, 42 inches.

D. Arms

A first set of arms 22, 32 are pivotally connected to the first support member 40 which are adapted to be pivotally connected to the wall 14 opposite of the first support member 40. It is preferable that the first set of arms 22, 32 is pivotally connected to one or more brackets 20, 30 attached to the wall 14 as illustrated in FIGS. 1 through 11 of the drawings. The arms 22, 32 are preferably comprised of a flat metal bar.

A second set of arms 22, 32 are pivotally connected to the second support member 50 which are adapted to be pivotally connected to the wall 14 opposite of the second support member 50. It is preferable that the second set of arms 22, 32 is pivotally connected to one or more brackets 20, 30 attached to the wall 14 as illustrated in FIGS. 1 through 11 of the drawings.

The first set of arms 22, 32 and the second set of arms 22, 32 each preferably have the same length to provide for a constant vertical support of the support members 40, 50 and parallel with respect to the wall 14 in all positions as illustrated in FIGS. 8*a* through 8*b* of the drawings. However, varying lengths for the arms 22, 32 may be utilized where the support members 40, 50 are not parallel with respect to the wall 14.

The first set of arms is preferably comprised of at least one upper arm 22 pivotally connected to the upper bracket 20 and at least one lower arm 32 pivotally connected to the lower bracket 30 as illustrated in FIGS. 1 through 4 of the drawings. The second set of arms is preferably comprised of at least one upper arm 22 pivotally connected to the upper bracket 20 and at least one lower arm 32 pivotally connected to the lower bracket 30 as illustrated in FIGS. 1 through 4 of the drawings. It is further preferable that two upper arms 22 are used to support the upper portion of the support members 40, 50 and two lower arms 32 are used to support the middle or lower portion of the support members 40, 50. Additional sets of arms may be used in addition to what is illustrated in the drawings (e.g. a pair of middle arms could be connected to a middle bracket between the upper arms 22 and the lower arms 32).

E. Actuators

At least one actuator 24, 34 is pivotally connected to one of the arms 22, 32 at a first end and is pivotally connected to the wall 14 at a second end. The actuator 24, 34 may be directly connected to the wall 14 or to one of the brackets 20, 30. The actuator 24, 34 applies an upward biasing force to the respective arm 22, 32 to assist in lifting the first support member 40 upwardly into the retracted position. The second support member 50 includes at least one corresponding actuator 24, 34 to assist in lifting the second support member 50 as illustrated in FIGS. 1 through 4 of the drawings.

The actuator 24, 34 is connected to the wall 14 in a manner offset from the pivot location of the respective arm 22, 32 as illustrated in FIGS. 8*a* through 8*d* of the drawings. The actuator 24, 34 is preferably pivotally connected to the wall 14 at a pivot axis that is forward and downward from the pivot axis of the corresponding arm 22, 32 pivotally connected to the wall 14 to provide an upward lifting force to the corresponding arm 22, 32 throughout the entire range of positions as best illustrated in FIGS. 8*a* through 8*d* of the drawings. The pivot axis of the actuator 24, 34 is preferably not concentric with the pivot axis of the corresponding arm 22, 32. The actuator 24, 34 preferably is connected centrally to the respective arm 22, 32 as illustrated in FIGS. 1, 2, 7 through 8*d* of the drawings.

As illustrated in FIGS. 1 through 4 of the drawings, each upper arm 22 preferably includes a corresponding upper actuator 24 connected between the upper bracket 20 and the upper arm 22. In addition, each lower arm 32 preferably includes a corresponding lower actuator 34 connected between the lower bracket 30 and the lower arm 32. Depending upon the force applied to the arms 22, 32 by the actuator 24, 34 and the weight of the support members 40, 50, a greater or less number of actuators 24, 34 may be used. For example, if larger actuators are used, only at least one upper actuator 24 or at least one lower actuator 34 may be needed. Alternatively, only a single actuator 24, 34 may be used connected to a single arm 22, 32 if sufficient force is applied. However, it is preferable to have at least one actuator 24, 34 for each of the support members 40, 50 to prevent an off-balance countering force being applied to the support members 40, 50.

The actuators 24, 34 are preferably comprised of linear actuators. Examples of suitable linear actuators include, but are not limited to, gas actuators, gas springs, pneumatic actuators, hydraulic actuators, hydraulic gas lift support arms, spring actuators, mechanical compression struts, compression actuators, dampers and the like. The actuators 24, 34 may also be rotary actuators such as, but not limited to, torsion springs, coil springs and the like. The actuators 24, 34 may be motorized such as an electro-mechanical actuator or servomotor actuator to lift the retractable wall mounted exercise rack from the extended position to the retracted position without the user having to lift the structure. In addition, a ratchet system may be connected to the arms 22, 32 to prevent the rack system 10 from lowering during a lifting procedure.

F. Locking System

The retractable wall mounted exercise rack preferably includes a locking system that allows for selectively locking the retractable wall mounted exercise rack system 10 into the retracted position. The user is able to selectively lock the invention to prevent the structure from accidentally falling downwardly into the extended position which could injure a child or damage a vehicle.

Figure 3:
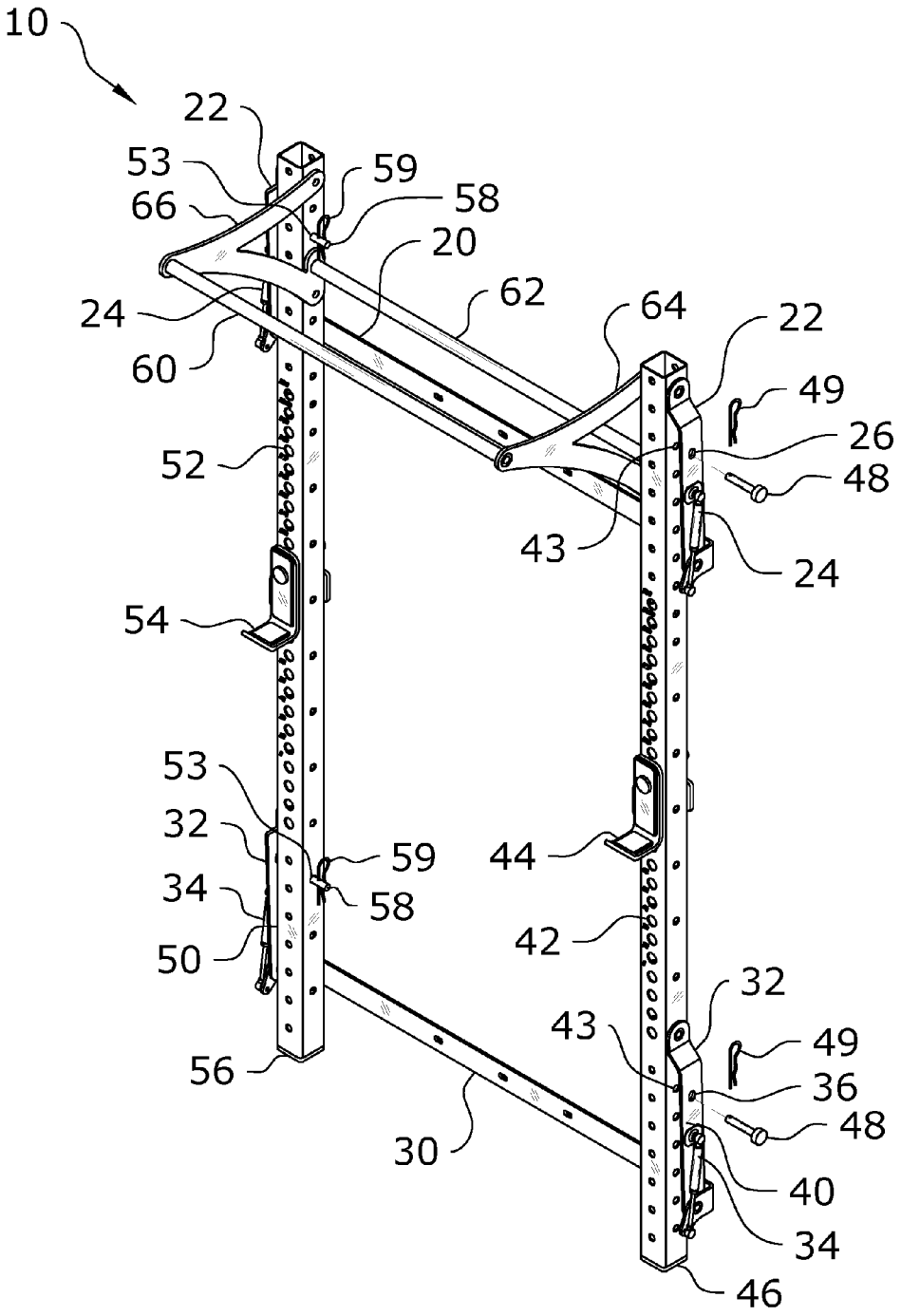
FIG. 3 is a first front perspective view of the retractable wall mounted exercise rack in the compact retracted position.
Figure 4:
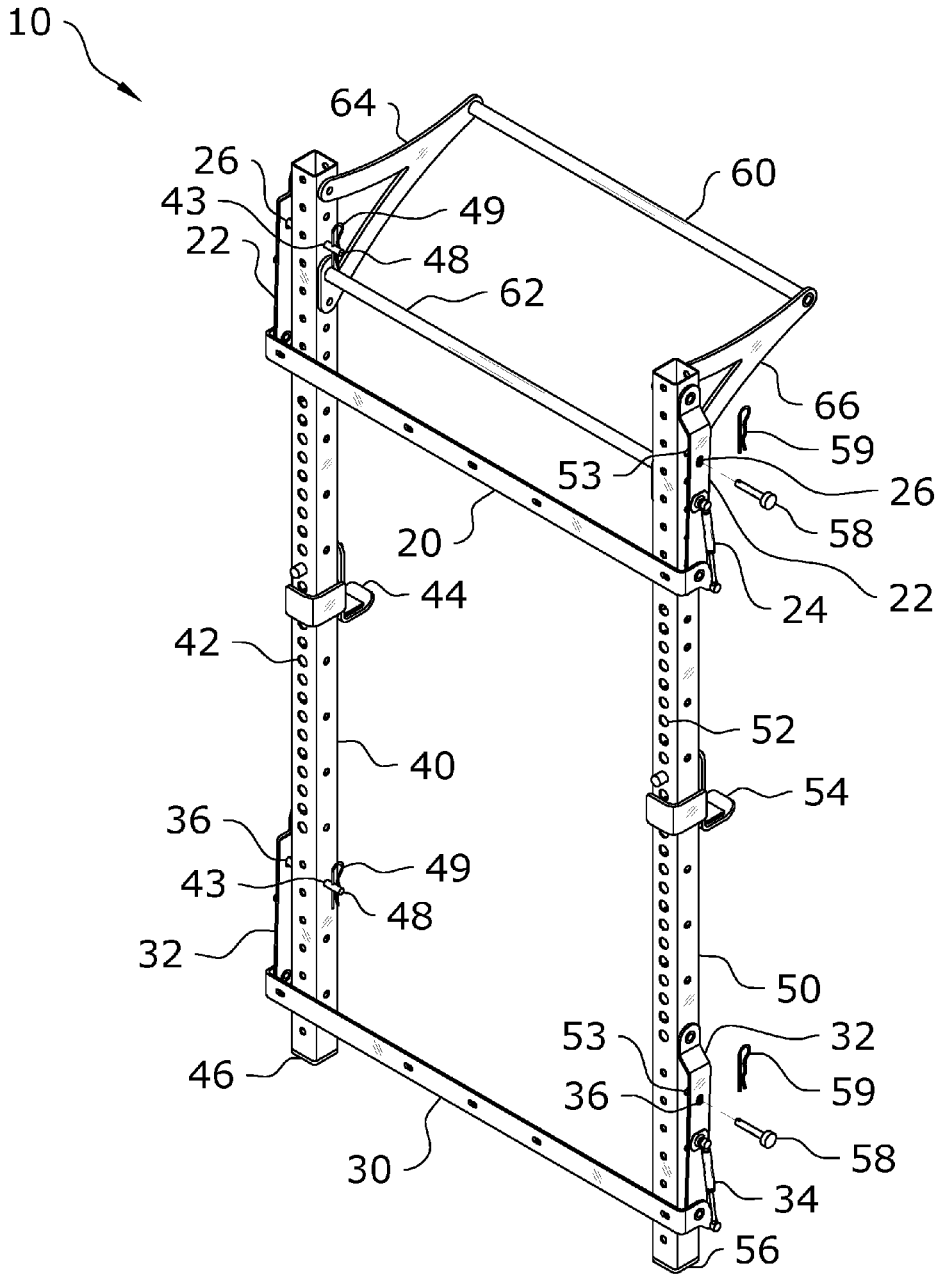
FIG. 4 is a first rear perspective view of the retractable wall mounted exercise rack in the compact retracted position.
Figure 5:
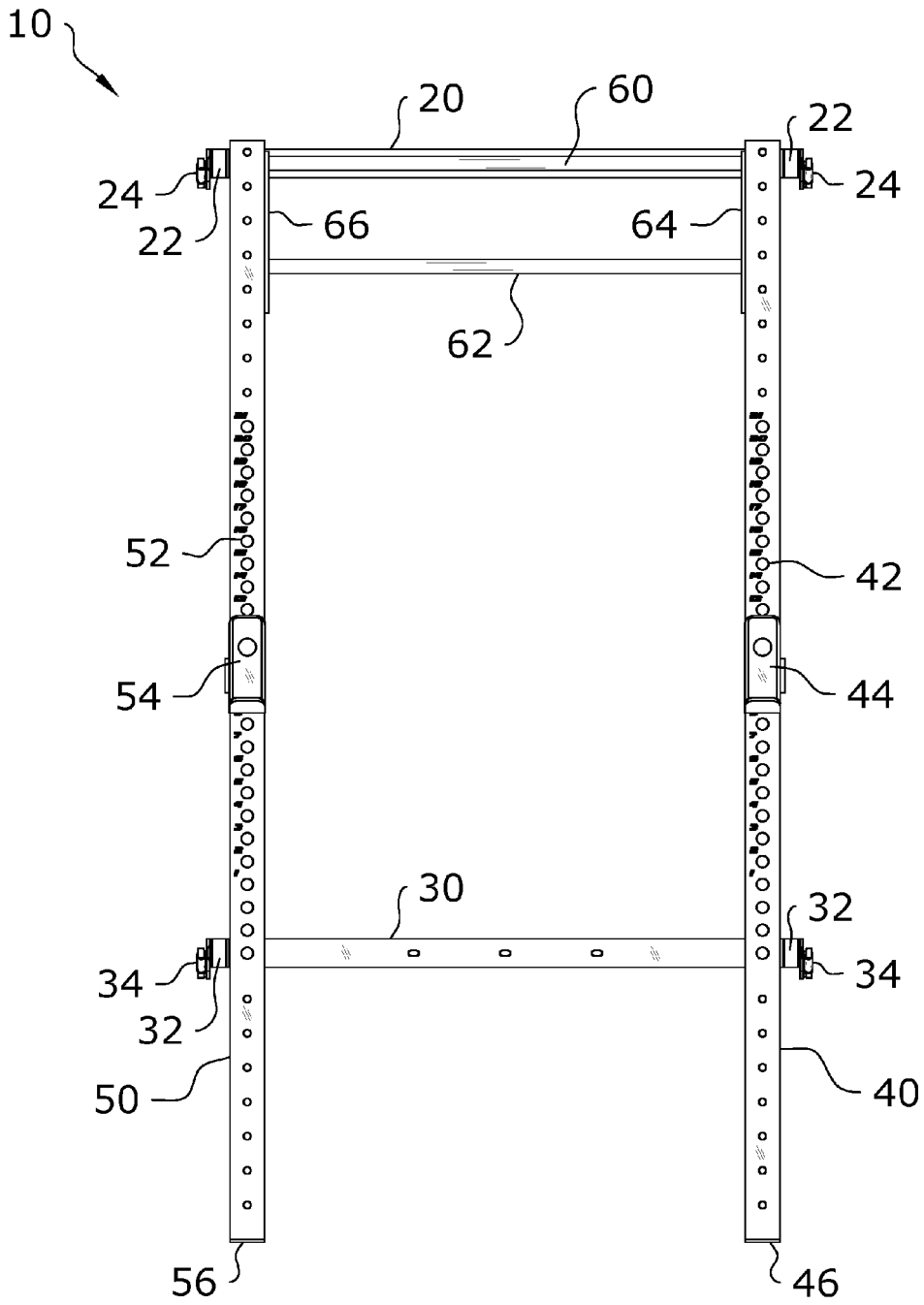
FIG. 5 is a front view of the retractable wall mounted exercise rack.
Figure 6:
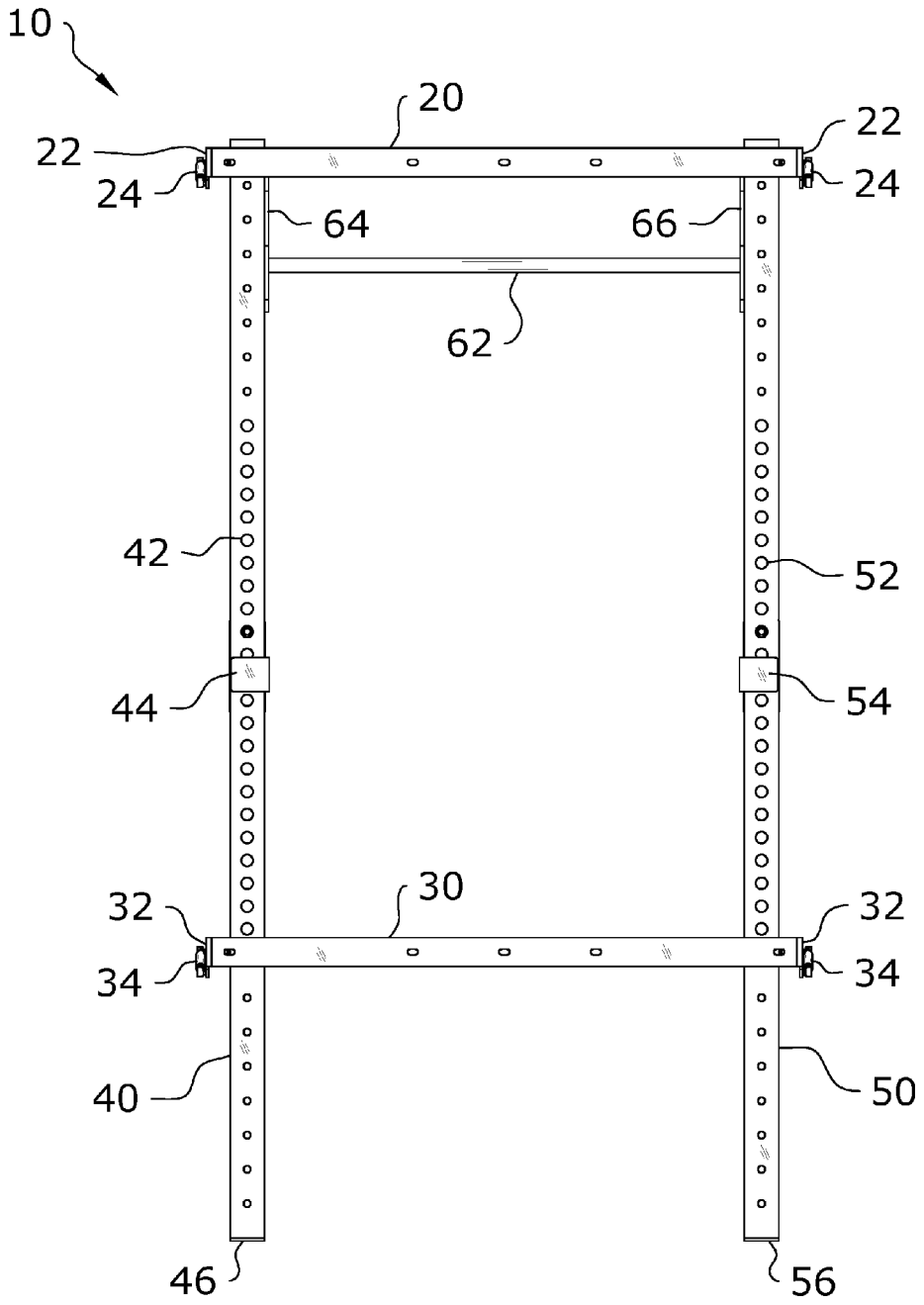
FIG. 6 is a rear view of the retractable wall mounted exercise rack.
Figure 7:
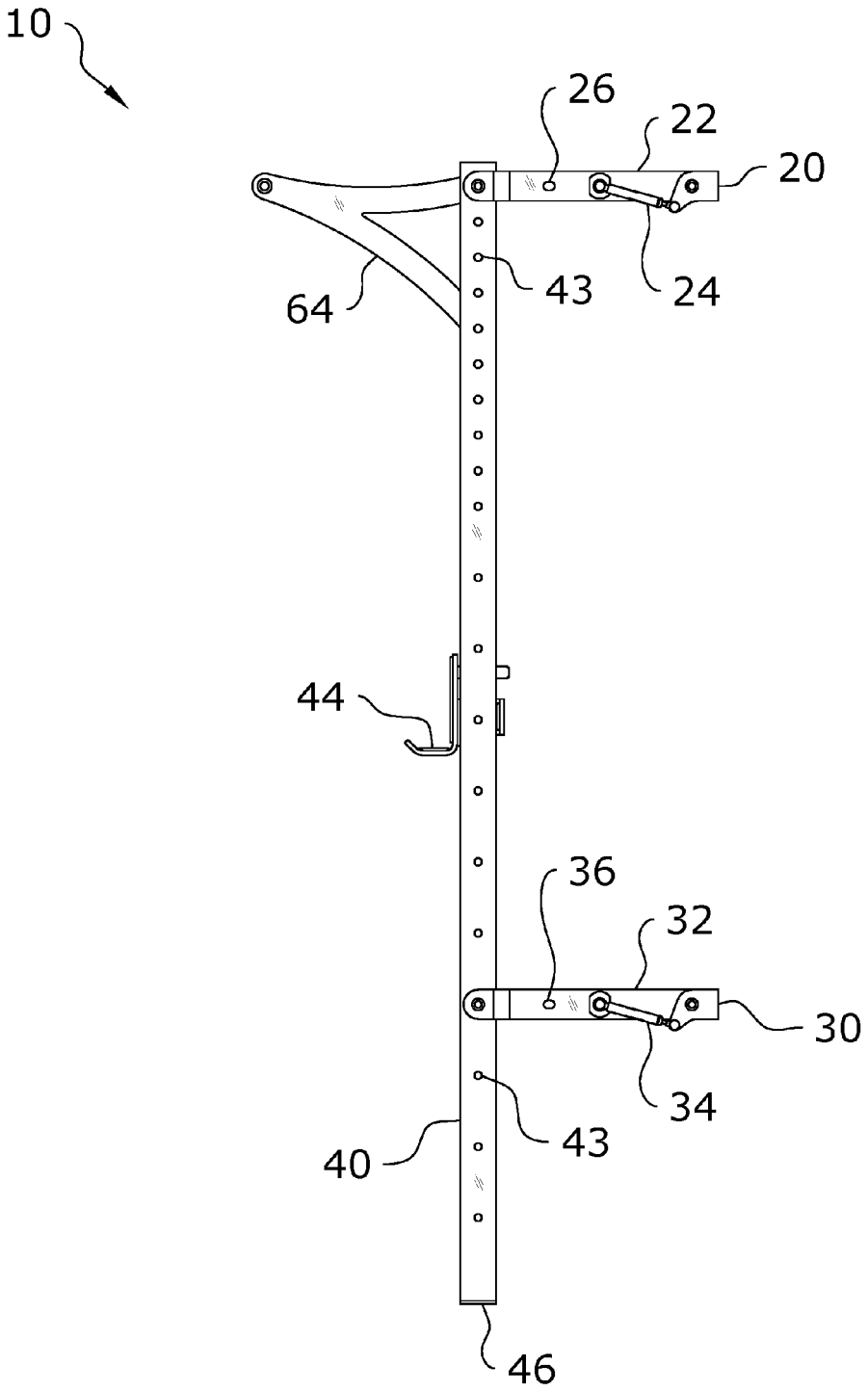
FIG. 7 is a right side view of the retractable wall mounted exercise rack.

A first locking aperture 26 extends within and through at least one of the upper arms 22 as illustrated in FIGS. 1 and 2 of the drawings. A first receiver aperture 43 extends within and through at least one of the support members 40, 50. The first locking aperture 26 is aligned with the first receiver aperture 43 when the corresponding support member 40, 50 is in the retracted position to removably receive a first locking pin 48 as illustrated in FIGS. 3 and 4 of the drawings. The first locking pin 48 extends through the first locking aperture 26 and the first receiver aperture 43 to lock the corresponding support member in the retracted position. A first clip 49 may be removably inserted through a hole within the distal portion of the first locking pin 48 to prevent accidental removal of the first locking pin 48.

A second locking aperture 36 extends within and through at least one of the lower arms 32 as illustrated in FIGS. 1 and 2 of the drawings. A second receiver aperture 53 extends within and through at least one of the support members 40, 50. The second locking aperture 36 is aligned with the second receiver aperture 53 when the corresponding support member 40, 50 is in the retracted position to removably receive a second locking pin 58 as illustrated in FIGS. 3 and 4 of the drawings. The second locking pin 58 extends through the second locking aperture 36 and the second receiver aperture 53 to lock the corresponding support member 40, 50 in the retracted position. A second clip 59 may be removably inserted through a hole within the distal portion of the second locking pin 58 to prevent accidental removal of the second locking pin 58. The clips 49, 59 may be comprised of any clip such as, but not limited to, a hitch pin clip.

G. Operation of Preferred Embodiment

In use, the upper bracket 20 and the lower bracket 30 are mounted to the wall 14 as illustrated in FIGS. 8*a* through 10 of the drawings. The retractable wall mounted exercise rack system 10 is then lowered into the extended position as illustrated in FIGS. 1, 2 and 8*a* of the drawings. The rack system 10 is pulled outwardly and lowered until the lower ends of the support members 40, 50 engage and are supported substantially by the floor 12 as best illustrated in FIG. 8*a* of the drawings. With the rack system 10 in the extended position, the user is able to perform the exercise of their choice such as, but not limited to, pull-ups, squats, bench presses and the like. The user may also adjust the desired position of the support brackets 44, 54 to support the barbell 16 at the desired height.

When the user is finished exercising, they remove the barbell 16 and lift upon the support members 40, 50 thereby causing the support members 40, 50 to lift upwardly and inwardly as illustrated in FIG. 8*b* of the drawings. The actuators 24, 34 provide assistance to the user by lifting upwardly upon the corresponding arms 22, 32 thereby reducing the amount of weight the user must lift. The support members 40, 50 are continued upwardly and inwardly until they engage the brackets 20, 30 and are near (or adjacent) to the wall 14 as illustrated in FIG. 8*c* of the drawings. The actuators 24, 34 are able to maintain the rack system 10 in the retracted position because there is little vertical force being applied to the actuators 24, 34 because of the substantially vertically aligned arms 22, 32 and support members 40, 50 as illustrated in FIG. 8*c*. However, to ensure that a child doesn't accidentally pull downwardly upon the rack system 10 causing a force that overcomes the actuators 24, 34, the user preferably inserts at least one locking pin 48, 58 through one of the locking apertures 26, 36 and corresponding receiver apertures 43, 53 to prevent the rack system 10 from being removed from the retracted position. At least one locking pin 48, 58 for each of the support arms are preferably utilized. When the user desires to use the rack system 10 again for exercise, they simply remove the locking pins 48, 58 and then pull downwardly and outwardly upon the support members 40, 50 thereby causing the rack system 10 to fall downwardly and outwardly into the extended position as illustrated in FIG. 8*a* of the drawings. The above process is then simply repeated for the continued life of the rack system 10.

Unless otherwise defined, all technical and scientific terms used herein have the same meaning as commonly understood by one of ordinary skill in the art to which this invention belongs. Although methods and materials similar to or equivalent to those described herein can be used in the practice or testing of the retractable wall mounted exercise rack, suitable methods and materials are described above. All publications, patent applications, patents, and other references mentioned herein are incorporated by reference in their entirety to the extent allowed by applicable law and regulations. The retractable wall mounted exercise rack may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A retractable wall mountable exercise rack, comprising:

a first support member;

a first set of arms connected to the first support member, wherein the first set of arms are adapted to be pivotally connected to a wall;

a second support member spaced apart from the first support member; and a second set of arms connected to the second support member, wherein the second set of arms are adapted to be pivotally connected to the wall;

wherein the support members have an extended position and a retracted position, wherein the support members are positioned near or adjacent to the wall when in the retracted position and wherein the support members are distally positioned away from the wall when in the extended position;

wherein the first support member and the second support member are substantially vertically orientated and substantially parallel to one another when in the extended position;

wherein the first support member includes a plurality of first apertures adapted to removably receive a first support bracket and wherein the second support member includes a plurality of second apertures adapted to removably receive a second support bracket, wherein the first support bracket and the second support bracket are configured to removably receive and support a barbell.

2. The retractable wall mountable exercise rack of claim 1, wherein the first support member and the second support member are vertically orientated when in the retracted position.

3. The retractable wall mountable exercise rack of claim 1, wherein the first set of arms are pivotally connected to the first support member and wherein the second set of arms are pivotally connected to the second support member.

4. The retractable wall mountable exercise rack of claim 1, wherein the first set of arms and the second set of arms each have the same length.

5. The retractable wall mountable exercise rack of claim 1, wherein the support members maintain a vertical orientation in all positions from the extended position to the retracted position.

6. The retractable wall mountable exercise rack of claim 1, including a first actuator pivotally connected to a first arm of the first set of arms, wherein the first actuator is adapted to be pivotally connected to the wall and wherein the first actuator applies an upward biasing force to the first arm to assist in lifting the first support member upwardly into the retracted position.

7. The retractable wall mountable exercise rack of claim 6, including a second actuator pivotally connected to a second arm of the second set of arms, wherein the second actuator is adapted to be pivotally connected to the wall and wherein the second actuator applies an upward biasing force to the second arm to assist in lifting the second support member upwardly into the retracted position.

8. The retractable wall mountable exercise rack of claim 1, wherein the support members are positioned higher when in the retracted position than when in the extended position.

9. The retractable wall mountable exercise rack of claim 1, wherein the support members include lower ends, wherein the lower ends engage a floor when in the extended position and wherein the lower ends are distally spaced above the floor when in the retracted position.

10. The retractable wall mountable exercise rack of claim 1, wherein the first support member is connected to the second support member by a connecting member.

11. The retractable wall mountable exercise rack of claim 1, wherein the first set of arms and the second set of arms are adapted to be pivotally connected to the wall along a horizontal axis.

12. The retractable wall mountable exercise rack of claim 1, wherein the first set of arms and the second set of arms are adapted to be pivotally connected to the wall along a vertical axis.

13. The retractable wall mountable exercise rack of claim 1, wherein a distance from the wall to an outer surface of the support members is significantly less when the support members are in the retracted position than when the support members are in the extended position.

14. The retractable wall mountable exercise rack of claim 1, including a first locking aperture within at least one arm of the first set of arms, a first receiver aperture within the first support member, and a first locking pin, wherein the first locking aperture is aligned with the first receiver aperture when the first support member is in the retracted position to removably receive a first locking pin extending through the first locking aperture and the first receiver aperture to lock the first support member in the retracted position.

15. The retractable wall mountable exercise rack of claim 1, including an upper bracket adapted to be attached to the wall and a lower bracket adapted to be attached to the wall below the upper bracket, wherein the first set of arms and the second set of arms are pivotally connected to the upper bracket and the lower bracket.

16. A retractable wall mountable exercise rack, comprising:

a first support member;

a first set of arms connected to the first support member, wherein the first set of arms are adapted to be pivotally connected to a wall;

a second support member spaced apart from the first support member; and a second set of arms connected to the second support member, wherein the second set of arms are adapted to be pivotally connected to the wall;

wherein the support members have an extended position and a retracted position, wherein the support members are positioned near or adjacent to the wall when in the retracted position and wherein the support members are distally positioned away from the wall when in the extended position;

wherein the first support member and the second support member are substantially vertically orientated and substantially parallel to one another when in the extended position and in the retracted position;

wherein a distance from the wall to an outer surface of the support members is significantly less when the support members are in the retracted position than when the support members are in the extended position;

wherein the first support member includes a plurality of first apertures adapted to removably receive a first support bracket and wherein the second support member includes a plurality of second apertures adapted to removably receive a second support bracket, wherein the first support bracket and the second support bracket are configured to removably receive and support a barbell.

17. The retractable wall mountable exercise rack of claim 16, wherein the first set of arms are pivotally connected to the first support member and wherein the second set of arms are pivotally connected to the second support member.

18. The retractable wall mountable exercise rack of claim 16, wherein the first set of arms and the second set of arms are adapted to be pivotally connected to the wall along a horizontal axis.

19. The retractable wall mountable exercise rack of claim 16, wherein the support members are positioned higher when in the retracted position than when in the extended position.

20. A retractable wall mountable exercise rack, comprising:

a first support member;

a first set of arms connected to the first support member, wherein the first set of arms are adapted to be pivotally connected to a wall;

a second support member spaced apart from the first support member;

a second set of arms connected to the second support member, wherein the second set of arms are adapted to be pivotally connected to the wall;

a pull-up bar connected between upper portions of the first support member and the second support member;

wherein the support members have an extended position and a retracted position, wherein the support members are positioned near or adjacent to the wall when in the retracted position and wherein the support members are distally positioned away from the wall when in the extended position;

wherein the first support member and the second support member are substantially vertically orientated and substantially parallel to one another when in the extended position and in the retracted position;

wherein a distance from the wall to an outer surface of the support members is significantly less when the support members are in the retracted position than when the support members are in the extended position;

wherein the distance from the wall to an outer surface of the support members is less than four inches when the support members are in the retracted position;

wherein the first support member includes a plurality of first apertures adapted to removably receive a first support bracket and wherein the second support member includes a plurality of second apertures adapted to removably receive a second support bracket, wherein the first support bracket and the second support bracket are configured to removably receive and support a barbell.

* * * * *